US008387626B2

(12) United States Patent
Kawata et al.

(10) Patent No.: US 8,387,626 B2
(45) Date of Patent: Mar. 5, 2013

(54) ORAL TOBACCO PRODUCT

(75) Inventors: Norio Kawata, Tokyo (JP); Manabu Takeuchi, Tokyo (JP); Manabu Yamada, Tokyo (JP)

(73) Assignee: Japan Tobacco Inc., Tokyo (JP)

( * ) Notice: Subject to any disclaimer, the term of this patent is extended or adjusted under 35 U.S.C. 154(b) by 0 days.

(21) Appl. No.: 13/309,130

(22) Filed: Dec. 1, 2011

(65) Prior Publication Data

US 2012/0073589 A1 Mar. 29, 2012

Related U.S. Application Data

(63) Continuation of application No. PCT/JP2010/060201, filed on Jun. 16, 2010.

(30) Foreign Application Priority Data

Jul. 2, 2009 (JP) ..... 2009-157843

(51) Int. Cl.
*A24B 15/00* (2006.01)

(52) U.S. Cl. ..... 131/352

(58) Field of Classification Search ..... 131/352
See application file for complete search history.

(56) References Cited

U.S. PATENT DOCUMENTS

| | | | | |
|---|---|---|---|---|
| 2008/0029110 | A1* | 2/2008 | Dube et al. | 131/275 |
| 2008/0029118 | A1* | 2/2008 | Nelson et al. | 131/365 |

FOREIGN PATENT DOCUMENTS

| | | | |
|---|---|---|---|
| JP | 2006-97222 | A | 4/2006 |
| WO | WO 2008/016520 | A2 | 2/2008 |
| WO | WO 2008/104891 | A2 | 9/2008 |
| WO | WO 2009/010878 | A2 | 1/2009 |

* cited by examiner

*Primary Examiner* — Richard Crispino
*Assistant Examiner* — Dionne Walls Mayes
(74) *Attorney, Agent, or Firm* — Birch, Stewart, Kolasch & Birch, LLP

(57) ABSTRACT

An oral tobacco product (1) has a pouch (2) made from a nonwoven fabric sheet and containing tobacco particles made from tobacco materials, for being designed to be put in a user's mouth to allow the user to absorb active constituents of tobacco from the tobacco particles via saliva, and a piece of string (6) with a flavoring added, disposed inside the pouch (2).

8 Claims, 5 Drawing Sheets

ORAL TOBACCO PRODUCT

CROSS REFERENCE TO RELATED APPLICATIONS:

This application is a Continuation of PCT International Application No. PCT/JP2010/060201 filed on Jun. 16, 2010, which claims the benefit of Patent Application No. 2009-157843 filed in Japan, on Jul. 2, 2009. The entire contents of all of the above applications are hereby incorporated by reference.

TECHNICAL FIELD

This invention relates to an oral tobacco product allowing users to absorb active constituents of tobacco via saliva.

BACKGROUND ART

Cigarettes have long been enjoyed as articles of tasting. In recent years, however, smokeless tobacco, which users are allowed to use in places where smoking is prohibited, including airplane cabins and train compartments, has been attracting attention. With the smokeless tobacco, users can absorb active constituents of tobacco and enjoy the flavor of tobacco anywhere.

Snus, an oral tobacco product belonging to the class of smokeless tobacco, contains tobacco shreds, or finely-shredded tobacco materials. The tobacco shreds for snus have a high moisture content. Specifically, snus is classified into a loose type, which has non-packaged tobacco shreds, and a portion type called also a pouch type, which has tobacco shreds packaged in a pouch of a nonwoven fabric or other material. The pouch-type snus is designed to be placed between a user's upper lip and gum so that the user can absorb active constituents of tobacco extracted into saliva, through the gum into the body.

With this type of oral tobacco products, the user can enjoy the taste of tobacco shreds only after the user's brain perceives that the active constituents of tobacco have been absorbed in the body. Thus, in an initial stage of use, or stage immediately after putting an oral tobacco product in the mouth, the user feels short on the taste of tobacco shreds, compared with normal cigarettes with the tobacco shreds ignited.

To deal with this, oral tobacco products with a flavoring added to a wrapper from which the pouch is made (Patent documents 1, 2) and an oral tobacco product including capsules containing a flavoring, disposed in the pouch (patent document 3) have been proposed.

PRIOR-ART DOCUMENT

Patent Document

Patent document 1: International Publication No. 2008/104891 Gazette

Patent document 2: International Publication No. 2009/010878 Gazette

Patent Document 3: U.S. Patent Application Laid-open No. 2008/029110 Specification

DISCLOSURE OF THE INVENTION

Problem to be Solved by the Invention

The oral tobacco products disclosed in patent documents 1 and 2 have a coating of a flavoring on the pouch surface. It is common to apply such coating by using a rotating drum, as disclosed in patent document 2. Pouches are however randomly agitated inside the rotating drum, which makes it difficult to uniformly add the flavoring onto the individual pouch surfaces, although a constant amount of the flavoring is sprayed into the rotating drum through a spray nozzle, and thus, leads to variations in the amount of the flavoring contained in the individual oral tobacco products. Further, as mentioned above, the tobacco shreds have a high moisture content to promote extraction of active constituents of tobacco, which leads to the flavoring on the pouch dissolving in moisture, and thus, a reduction in the flavoring on the pouch surface. The oral tobacco products disclosed in patent documents 1 and 2 therefore cannot provide adequate, reliable and stable release of a flavor in the initial stage of use.

The capsules contained in the oral tobacco product disclosed in patent document 3 are not broken only by the user's putting the oral tobacco product in the mouth. This means that the oral tobacco product disclosed in patent document 3 cannot provide immediate release of a flavor from the capsules in the initial stage of use.

An object of the present invention is to provide an oral tobacco product with a fixed amount of a flavoring added, which can provide reliable and stable release of the flavor of the flavoring from the initial stage of use.

Means for Solving the Problem

In order to achieve the above object, an oral tobacco article according to the present invention comprises a pouch containing tobacco particles made from tobacco materials, for being designed to be put in a user's mouth to allow the user to absorb active constituents of tobacco from the tobacco particles via saliva, and at least one piece of string with a flavoring added in a fixed amount per unit length of the string, disposed inside the pouch.

By including a fixed length of the string in each tobacco product, it is ensured that individual tobacco products contain a desired, fixed amount of the flavoring. Such tobacco products can provide adequate release of a flavor from the flavoring contained in the tobacco particles and the string from the initial stage of use. The user can therefore have a feeling of full satisfaction.

The tobacco particles may contain, as an additive, a flavoring that is identical to or different from the flavoring added to the string, which enables the user's fuller satisfaction.

The flavoring may be added to the string in liquid form in a way that the string is impregnated with the liquid-form flavoring, or in powder form in a way that the powder-form flavoring is attached to the string. This allows the string to contain the flavoring in good manner.

The tobacco particles have desirably a pH between 6.5 and 9.5 to keep their good flavor.

The tobacco particles have desirably a moisture content between 15 and 50 weight % to be suitable for extraction of active constituents of tobacco into saliva.

Effect of the Invention

The oral tobacco product according to the present invention can inhibit escape of the flavoring during storage, and stably provide a flavor during use.

MODE OF CARRYING OUT THE INVENTION

Figure 1:
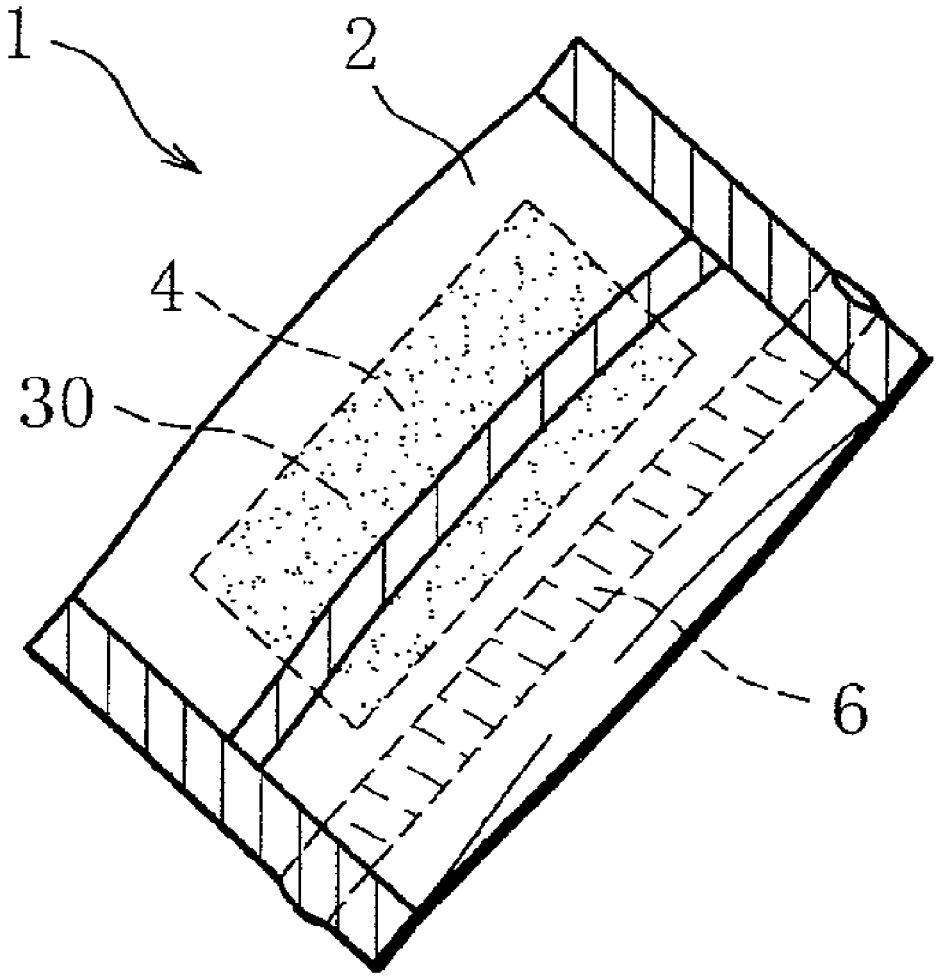
FIG. 1 is a schematic diagram showing an oral tobacco product which is an embodiment of the present invention.

As shown in FIG. 1, an oral tobacco product 1 (hereinafter referred to simply as "tobacco product 1") comprises tobacco shreds, or particles 4 contained in a pouch 2. The tobacco particles 4 are obtained by shredding or pulverizing tobacco materials to particle diameter of 2 mm or less. The pouch 2 is made from a non-woven fabric sheet. In use, the tobacco product 1 is put in a user's mouth. Specifically, the tobacco product 1 is placed between the user's upper lip and gum to allow the user to absorb active constituents of tobacco, which are extracted from the tobacco particles 4 into saliva, through the gum into the body. The user can thus absorb the active constituents of tobacco from the tobacco particles 4 while enjoying the flavor of the tobacco particles 4. Since the tobacco product 1 does not emit smoke in use, the user can use the tobacco product 1 anywhere.

Figure 2:
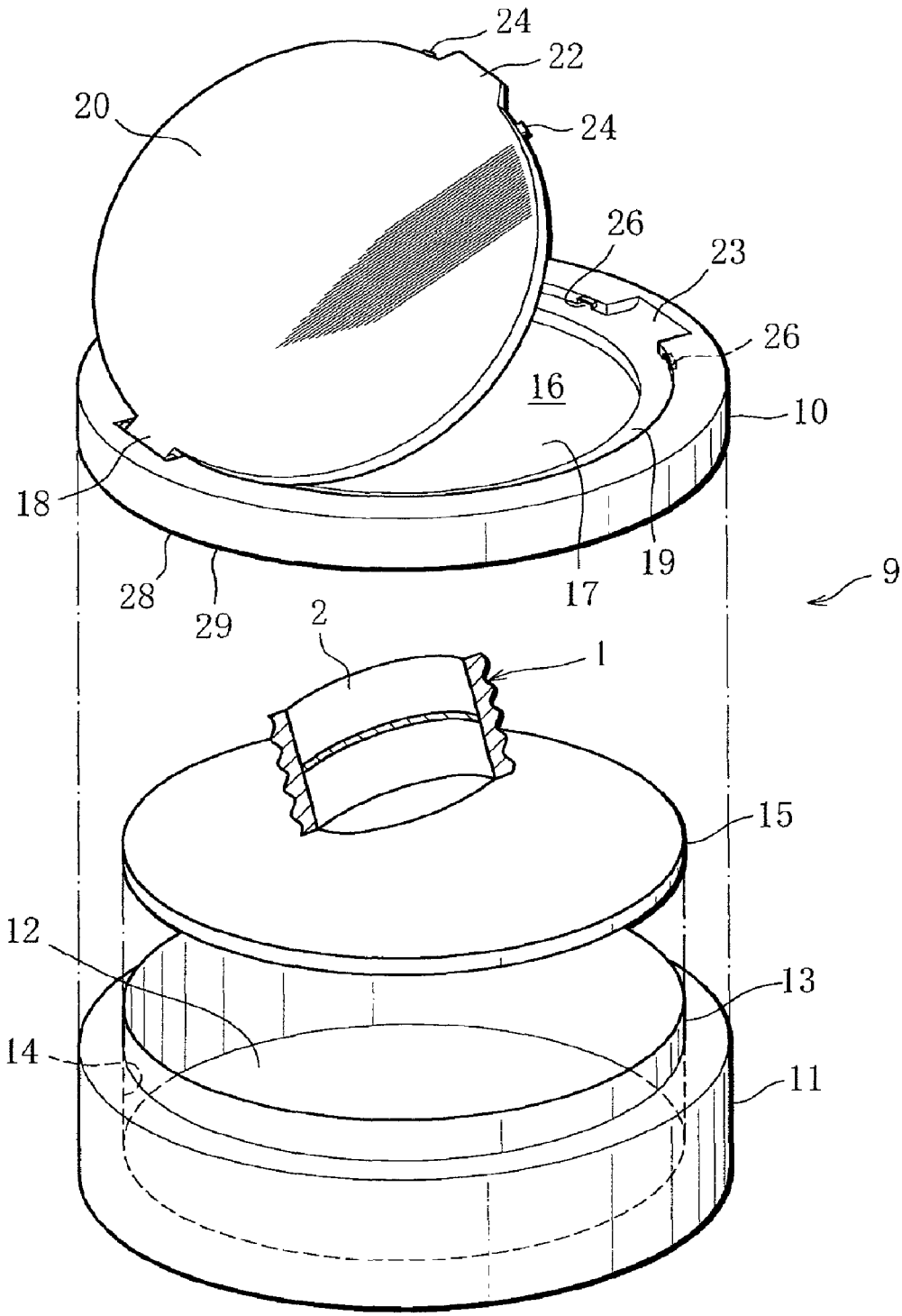
FIG. 2 is a perspective view of a container case for the tobacco product shown in FIG. 1.

Before use, the tobacco products 1 are normally held in a portable container or a portable case 9. FIG. 2 shows the details of the case 9. The case 9 comprises a case body 11, a mat 15 and a lid 10. The case body 11 is in a flat cylindrical shape, and has a circular opening 13 at the top thereof. Specifically, the case body 11 has an upward-projecting portion which provides the opening 13. The opening 13 is closed with an openable and closable lid 10.

The mat 15 is in a circular shape with a diameter approximately equal to a diameter of an inner wall surface 14 of the case body 11. The mat 15 is placed at the bottom 12 of the case body 11. A lot of tobacco products 1 are stacked on the mat 15 in the case body 11.

The lid 10 has an approximately-circular stepped recess 16 in the upper face. The stepped recess 16 has a bottom 17 and an annular rest surface 19 around the bottom 17. The depth up to the rest surface 19 is smaller than the depth up to the bottom 17. A hinge 18 is provided at the periphery of the lid 10, adjacent to the recess 16, to connect a circular cover 20 with the lid 10. The cover 20 has a diameter approximately equal to the outside diameter of the rest surface 19. The cover 20 is turned upward or downward on the hinge 18 to give access to or close the recess 16. The recess 16 is closed with the cover 20 seated on the rest surface 19, where the top of the lid 10, or its annular top surface is flush with the upper face of the cover 20.

The cover 20 has a knob 22 projecting from the circumference thereof. The knob 22 and the hinge 18 are located apart from each other in a diametrical direction of the cover 20. The user can take the knob 22 between fingers and raise, thus open the cover 20. With the cover 20 closed, the knob 22 is received in a shallow shelf 23 in the annular top surface of the lid 10.

The cover 20 also has a pair of claws 24 slightly projecting from the circumference thereof, on either side of and adjacent to the knob 22, while the inner rim between the annular top surface and the rest surface 19 of the lid 10 has pits 26 at the locations corresponding to the claws 24. Thus, the cover 20 is closed with the claws 24 engaged with the pits 26, and thus, kept in the closed position.

The recess 16 can be used to temporarily hold used tobacco products 1. In other words, the lid 10 serves also as a portable trash container. The case 9 can thus hold unused tobacco products 1 and used tobacco products 1, separately.

Also the lower face of the lid 10 has a circular recess 29. The recess 29 has a size suited to receive the opening portion 13 or the upper-projecting portion of the case body 11. The ceiling 28 of the recess 29 serves as a surface for holding the tobacco products 1 down within the case body 11.

As mentioned above, conventional tobacco products of this type have a drawback that in the initial stage of use, the user feels short on the original flavor of tobacco particles, compared with cigarettes.

Figure 3:
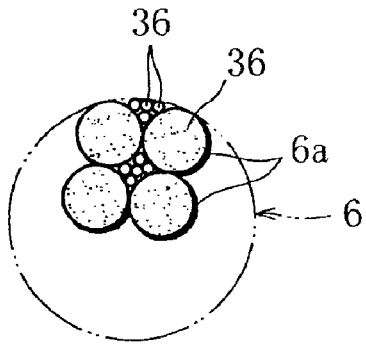
FIG. 3 is a cross-sectional view of string with a food flavoring added.

To deal with this, the tobacco product 1 according to the present invention further comprises a food flavoring 30 added to the tobacco particles 4, and a piece of flavoring-added string 6. The flavoring-added string 6 is disposed inside the pouch 2. Specifically, as shown in FIG. 3, the flavoring-added string 6 includes threads functioning as absorbing element **6*a* and a food flavoring 36, where the food flavoring 36 is added in liquid form in a way that the absorbing element 6*a* is impregnated with the liquid-form food flavoring, and in solid form, for example powder form in a way that the solid-form food flavoring is adhered to the absorbing element 6*a*. The food flavoring 36 is added to the absorbing element 6*a* in a fixed amount per unit length of the absorbing element 6*a*. The absorbing element 6*a* is threads of cotton, for example. The food flavoring 36 may be added to the absorbing element 6*a* either in liquid form or in solid form, not both in liquid form and in solid form. The liquid- or solid-form food flavoring 36 may contain a humectant. The humectant may be disposed in the case 9** in another manner.

Food flavorings usable as the flavorings 30, 36 include menthol, mint, vanilla, apricot, tea, cacao, licorice, honey, and combinations of two or more of these food flavorings. Solvents usable for the liquid-form food flavoring 36 include water, alcohol, glycerin and propylene glycol. Humectants usable are glycerin and propylene glycol. Desirably, the food flavorings 30, 36 and the humectant are neutral or alkaline, since the tobacco particles 4 are alkaline.

To verify the effect of the food flavoring 36 contained in the embodiment tobacco products 1, comparative products with the food flavoring added only to the tobacco particles were prepared. The comparative products and the embodiment tobacco products 1 were left at room temperature for one week, and then used by evaluators. In the initial stage of use of the comparative products, the evaluators felt short on the flavor of the flavoring. By contrast, in the initial stage of use of the embodiment tobacco products 1, the evaluators adequately felt the flavor of the flavoring, and thus, felt fully satisfied with the tobacco products 1. This difference is thought to be caused by the fact that the absorbing element **6*a* of the flavoring-added string 6 contain an adequate amount of the food flavoring 36**.

Figure 4:
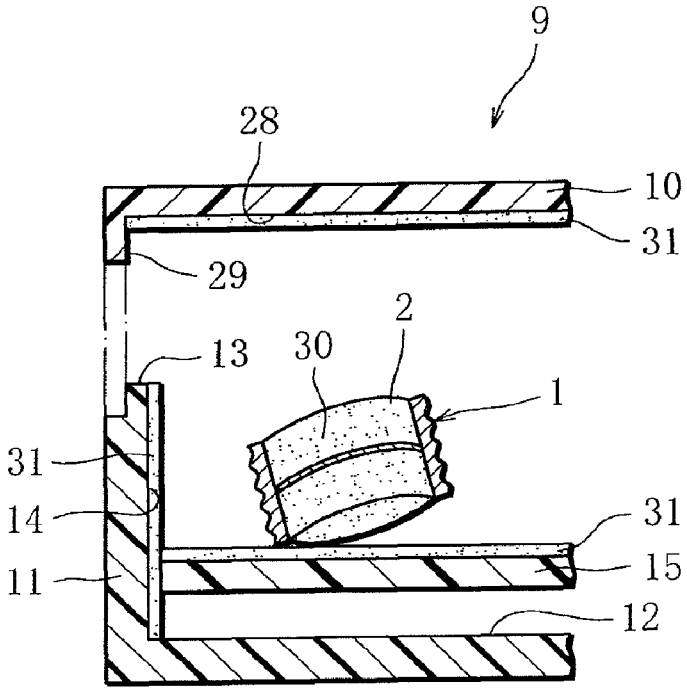
FIG. 4 is a partial cross-sectional view of the container case.

The food flavoring may also be applied to a surface of the pouch, or non-woven fabric sheet, and/or an inner surface of the case 9. Specifically, as shown in FIG. 4, a layer 31 of the food flavoring is applied to an inner wall surface 14 of the case body 11, an upper surface of the mat 15, and the ceiling of the lid 10. If a coupon is put in the case 9, a layer of the food flavoring may be applied also to the coupon.

When the case 9 is opened and closed by removing and putting back the lid 10 over and over again, part of the flavor constituents of the food flavoring vaporizes and escapes from the tobacco products 1. Such loss of the flavor constituents in the tobacco particles 1 is however compensated for by the flavor constituents released from the aforementioned layer 31 of the food flavoring. Thus, the tobacco products 1 in the case 9 stably keep almost the same performance to release the flavor constituents of the food flavoring as the tobacco products 1 have just after manufactured. The user can therefore satisfactorily enjoy the flavor of the food flavoring from the initial stage of use of the tobacco product 1.

Next, referring to FIG. 5, the manufacturing process from forming of tobacco products 1 up to putting them into cases will be described.

Figure 5:
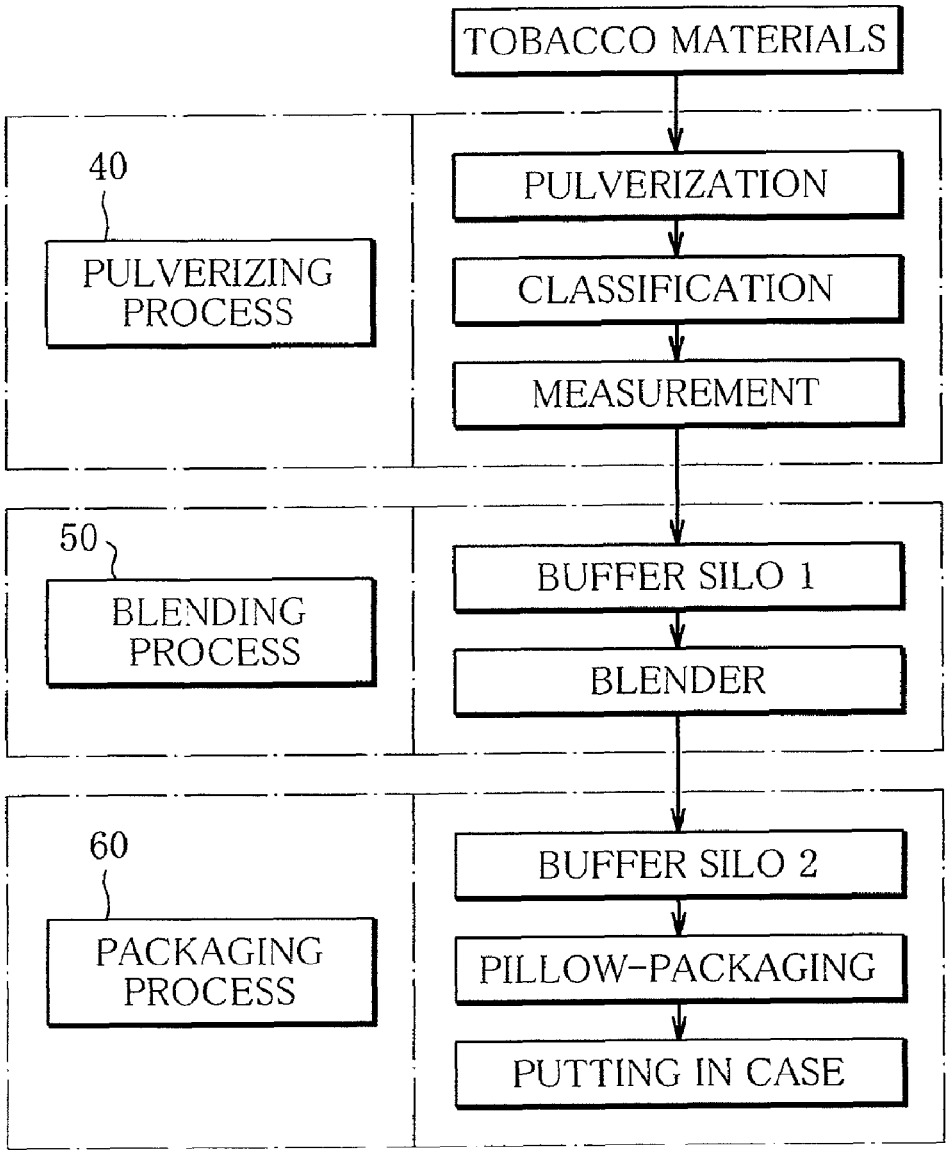
FIG. 5 is a block diagram showing a manufacturing process from manufacture of tobacco products shown in FIG. 1 up to packing them into cases.

As shown in FIG. 5, the manufacturing process includes a pulverizing process 40, a blending process 50 and a packaging process 60.

First, in the pulverizing process 40, supplied tobacco materials, specifically, laminae and stems of domestic Burley tobacco are separately pulverized to particle diameter of 2 mm or less using a pulverizer. The resulting two types of tobacco particles are each put in a classifier to sort out tobacco particles with predetermined size. Then, the two types of tobacco particles, namely lamina-derived and stem-derived tobacco particles are measured out in the proportion of 50 to 50 weight % and brought to the blending process 50.

In the blending process 50, the two types of tobacco particles are moved to a buffer silo 1 to be stored therein for a predetermined period of time. After the predetermined period of storage in the buffer silo 1, the tobacco particles are heat-sterilized and cooled, and then subjected to a blender processing. By the blender processing, the two types of tobacco particles are mixed, and additives including a food flavoring are added to them.

Specifically, first, water is added to the tobacco particles so that the tobacco particles contain 15 weight % of moisture. Then, the tobacco particles are sterilized by being heated at 100° C. for 4 hours, and then cooled by circulating coolant water.

Then, the cooled tobacco particles are mixed with 10 weight % of potassium carbonate, 1 weight % of vitamin C, and 1 weight % of sodium chloride. To the resulting mixture, 4 weight % of a flavoring, containing menthol as a main ingredient, is sprayed. The mixture with the flavoring thus added is then brought to the packaging process 60.

At this stage, the mixture is regulated so that the tobacco particles 4 in the mixture have a moisture content of between 10 and 50 weight %. Specifically, in the present embodiment, the mixture is regulated so that the mixture has a moisture content of 40 weight % and the tobacco particles in the mixture have a pH between 6.5 and 9.5.

In the packaging process 60, the mixture is stored in a buffer silo 2 for a predetermined period of time.

Besides the above-described mixture forming process, a process for producing continuous string 7 for obtaining the aforementioned flavoring-added string 6, is conducted. The continuous string 7 is string impregnated with a liquid-form food flavoring. In the present example, the food flavoring used here is identical to that added to the tobacco particles 4. Specifically, the string is impregnated with 1 weight % of the menthol solution.

Figure 6:
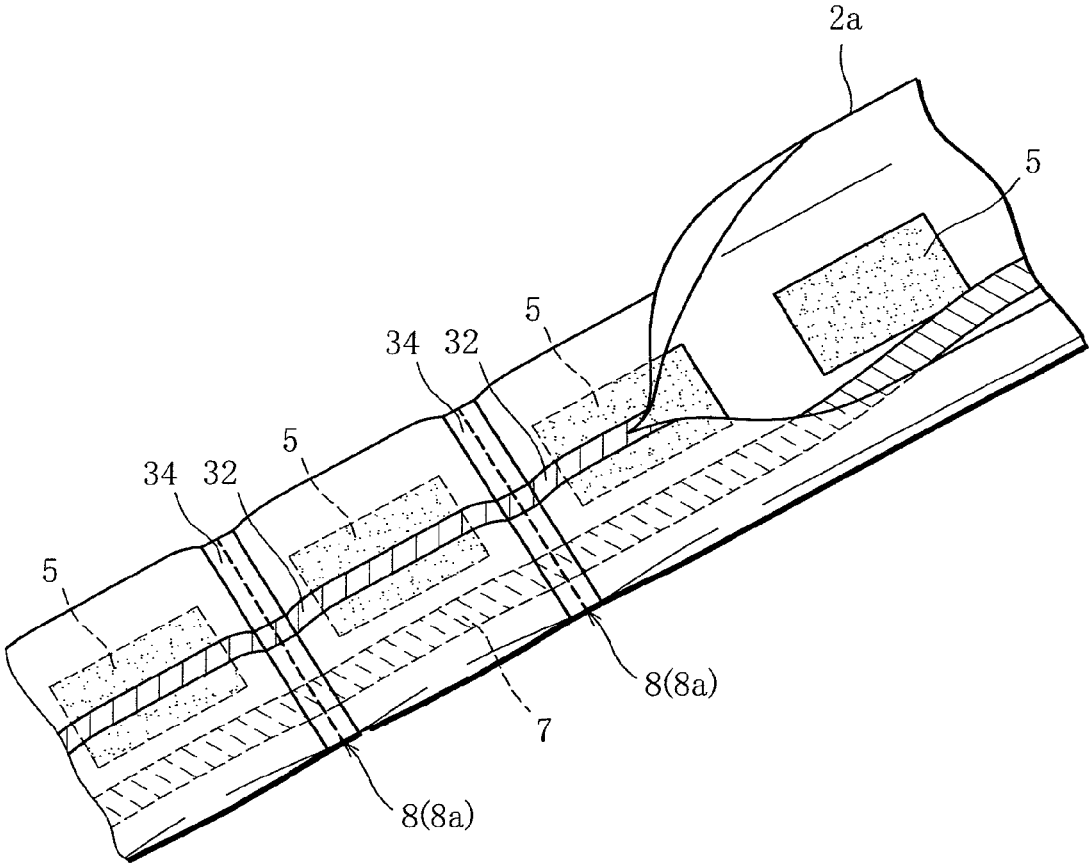
FIG. 6 is a schematic diagram showing how the tobacco products shown in FIG. 1 are manufactured.

Then, the mixture stored in the buffer silo 2 and the continuous string 7 are supplied to a pillow packaging machine (not shown). With the packaging machine, tobacco products 1 are manufactured as follows:

First, as shown in FIG. 6, on a web 2*a* of non-woven fabric running in one direction, 0.3 g-portions of the mixture 5 are supplied at predetermined intervals in the longitudinal direction of the web 2*a*, and the continuous string 7 is supplied parallel to the row of the mixture 5 portions. The web 2*a* is continuously formed into a tube with the mixture portions 5 and the continuous string 7 enclosed therein, where the opposite edges of the web 2*a* are joined together to form a longitudinal seal 32, and transverse seals 34 are formed at the tube between the mixture portions 5. Then, the tube is cut along cut lines 8, or center lines of the transverse seals 34, together with the continuous sting 7, so that individual tobacco products 1 are obtained. Specifically, the tobacco product 1 is in the shape of a rectangular measuring approximately 12 mm by 25 mm.

Then, a predetermined number of the tobacco products 1 are put in a single case 9 so that a single package of the oral tobacco products 1 is completed.

As understood from the above description, the tobacco product 1 includes the flavoring-added string 6 disposed inside the pouch 2 together with the mixture 5, or tobacco particles 4. The food flavoring 30, 36 contained in the tobacco particles 4 and the flavoring-added string 6 can adequately release the flavor from the initial stage of use of the tobacco product 1, which allows the user to have a feeling of full satisfaction. The flavoring-added string 6 contains a fixed amount of the food flavoring 36 per unit length in the manner that it is impregnated with the liquid-form food flavoring and/or the solid-form food flavoring is adhered thereto, so that every tobacco product 1 contains a fixed amount of the food flavoring 36. The flavoring-added string 6 is compressed at the locations of the transverse seals 34, namely at the opposite ends thereof, which means that each of the flavoring-added string 6 has small cut surfaces, and thus, escaping of the vaporized food flavoring 36 from the cut ends of the flavoring-added string 6 is reduced.

The present invention is not limited to the above-described embodiment, which can be modified in various ways.

For example, the flavoring-added string 6 may be impregnated with a food flavoring 36 which is different from the flavoring 30 added to the tobacco particles 4. This enables combinations of a variety of food flavorings, and thus, enables providing of tobacco products 1 suiting a variety of users' needs.

The food flavorings usable in the tobacco products are not restricted to the above-mentioned ones. Any desired neutral or alkaline food flavoring that does not deteriorate the original flavor and quality of the tobacco particles may be used.

The absorbing element 6*a* constituting the flavoring-added string 6 does not need to be cotton threads. The absorbing element 6*a* may be made of one of flexible absorbent materials including paper.

The tobacco product 1 according to the present invention may be modified such that the whole flavoring-added string 6, obtained by cutting the continuous string 7, is disposed in the interior space of the pouch 2 together with the mixture 5. This modification is free of a problem such that in manufacture of the tobacco products 1, the transverse seals cannot establish perfect sealing due to the presence of the continuous string 7, and provides the possibility of putting more than one flavoring-added string 6 in the pouch 2.

In manufacture of the tobacco products 1, in place of cutting along the cut lines 8, perforation lines 8*a* may be made at the center of the transverse seals 34. In this case, series of a predetermined number of tobacco products 1 separably connected by the perforation lines are obtained. A single series of tobacco products is rolled and put in a case 9.

Explanation Of Reference Characters

1: Oral tobacco product

2: Pouch

2*a*: Web

4: Tobacco particles
5: Mixture
6: Flavoring-added string
6*a*: Absorbing element
7: Continuous string
8: Cut line
8*a*: Perforation line
9: Case
10: Lid
11: Case body
12: Bottom
13: Opening
14: Inner wall surface
15: Mat
16: Recess
17: Bottom
18: Hinge
19: Rest surface
20: Cover
22: Knob
23: Shallow shelf
24: Claw
26: Engagement hole
28: Ceiling
29: Recess
30, 36: Food Flavoring
31: Layer
32: Longitudinal seal
34: Transverse seal
40: Pulverizing process
50: Blending process
60: Packaging process

The invention claimed is:

1. An oral tobacco product comprising:

a pouch containing tobacco particles made from tobacco materials, for being designed to be put in a user's mouth to allow the user to absorb active constituents of tobacco from the tobacco particles via saliva, said pouch including a longitudinal axis and two end seals separated from each other along the longitudinal direction, and at least one piece of string with a flavoring added in a fixed amount per unit length of said string, disposed inside said pouch, wherein said string extends along the longitudinal direction of said pouch and has two ends anchored to the end seals of said pouch, respectively.

2. The oral tobacco product according to claim 1, wherein the tobacco particles contains a flavoring identical to or different from the flavoring added to said string.

3. The oral tobacco product according to claim 1, wherein the flavoring is added to said string in liquid form in a way said string is impregnated with the liquid-form flavoring, or in powder form in a way that the powder-form flavoring is adhered to said string.

4. The oral tobacco product according to claim 1, wherein the tobacco particles have a pH between 6.5 and 9.5.

5. The oral tobacco product according to claim 1, wherein the tobacco particles have a moisture content between 15 and 50 weight %.

6. The oral tobacco product according to claim 1, wherein the ends of said string are formed as cut ends at the end seals of said pouch, respectively.

7. The oral tobacco product according to claim 6, wherein the ends of said string have a cross section smaller than that of the other portion of said string.

8. The oral tobacco product according to claim 7, wherein the ends of said string are in compressed state.

* * * * *